US011969009B2

(12) United States Patent
Kim et al.

(10) Patent No.: US 11,969,009 B2
(45) Date of Patent: Apr. 30, 2024

(54) COVER ASSEMBLY AND AEROSOL GENERATING DEVICE INCLUDING THE SAME

(71) Applicant: KT&G CORPORATION, Daejeon (KR)

(72) Inventors: Dong Sung Kim, Seoul (KR); Heon Jun Jeong, Seoul (KR); Won Kyeong Lee, Guri-si (KR); Jae Sung Choi, Seongnam-si (KR)

(73) Assignee: KT&G CORPORATION, Daejeon (KR)

( * ) Notice: Subject to any disclaimer, the term of this patent is extended or adjusted under 35 U.S.C. 154(b) by 488 days.

(21) Appl. No.: 17/421,977

(22) PCT Filed: Mar. 19, 2021

(86) PCT No.: PCT/KR2021/003410
§ 371 (c)(1),
(2) Date: Jul. 9, 2021

(87) PCT Pub. No.: WO2021/251597
PCT Pub. Date: Dec. 16, 2021

(65) Prior Publication Data

US 2023/0144176 A1 May 11, 2023

(30) Foreign Application Priority Data

Jun. 12, 2020 (KR) ..... 10-2020-0071866

(51) Int. Cl.
*A24F 40/40* (2020.01)
*A24F 40/42* (2020.01)

(52) U.S. Cl.
CPC ..... *A24F 40/40* (2020.01); *A24F 40/42* (2020.01)

(58) Field of Classification Search
None
See application file for complete search history.

(56) References Cited

U.S. PATENT DOCUMENTS 10,701,973 B2 7/2020 Lee
10,799,652 B2 10/2020 Finger
(Continued)

FOREIGN PATENT DOCUMENTS

KR 10-1094727 B1 12/2011
KR 10-1362648 B1 2/2014
(Continued)

OTHER PUBLICATIONS

Extended European Search Report dated Jan. 25, 2022 in Application No. 21736950.3.
(Continued)

*Primary Examiner* — James Harvey
(74) *Attorney, Agent, or Firm* — Sughrue Mion, PLLC

(57) ABSTRACT

A cover assembly includes a mouthpiece including one end, that is configured to come into contact with a mouth of a user, and another end opposite to the one end, the mouthpiece configured to move to an open position and a closed position by rotation of the mouthpiece around the other end; and an accommodation unit for accommodating the one end of the mouthpiece in the closed position. The accommodation unit includes a button unit including a body, the button unit configured to contact the one end of the mouthpiece and to be displaced in a longitudinal direction based on the one end being pressed; and a locking unit including a body, the body of the locking unit including a first portion that is configured to contact the one end of the mouthpiece and a second portion that is configured to contact the button unit.

15 Claims, 10 Drawing Sheets

(56) References Cited

U.S. PATENT DOCUMENTS

| | | | | |
|---|---|---|---|---|
| 11,369,145 | B2 * | 6/2022 | Kim | A24F 40/57 |
| 2007/0125765 | A1 | 6/2007 | Nelson | |
| 2010/0063408 | A1 | 3/2010 | Nothacker et al. | |
| 2015/0053217 | A1 | 2/2015 | Steingraber et al. | |
| 2016/0031631 | A1 | 2/2016 | Kim | |
| 2016/0050975 | A1 | 2/2016 | Worm et al. | |
| 2017/0056608 | A1 * | 3/2017 | McDerment | A61M 15/004 |
| 2021/0086960 | A1 * | 3/2021 | Wang | B65D 25/46 |
| 2023/0372645 | A1 * | 11/2023 | Adam | A61M 15/002 |

FOREIGN PATENT DOCUMENTS

| | | | |
|---|---|---|---|
| KR | 10-2017-0102261 | A | 9/2017 |
| WO | 94/16759 | A1 | 8/1994 |
| WO | 2017/007252 | A1 | 1/2017 |

OTHER PUBLICATIONS

International Search Report for PCT/KR2021/003410 dated Jun. 29, 2021 (PCT/ISA/210).
Written Opinion for PCT/KR2021/003410 dated Jun. 29, 2021 (PCT/ISA/237).

* cited by examiner

COVER ASSEMBLY AND AEROSOL GENERATING DEVICE INCLUDING THE SAME

CROSS REFERENCE TO RELATED APPLICATIONS

This application is a National Stage of International Application No. PCT/KR2021/003410 filed Mar. 19, 2021, claiming priority based on Korean Patent Application No. 10-2020-0071866 filed Jun. 12, 2020.

TECHNICAL FIELD

The present disclosure relates to a cover assembly and an aerosol generating device to which the cover assembly is applied.

BACKGROUND ART

Recently, various types of devices to which mouthpieces are applied have been used. However, foreign materials may flow into mouthpieces through an externally exposed mouth portion, and thus there is a problem in terms of hygiene.

In addition, there is a disadvantage in that an appearance is not good and portability of a user is poor due to the exposed mouth portion. Accordingly, there is a need for a cover assembly including a mouthpiece with improved hygiene, aesthetics, and portability.

DISCLOSURE

Technical Problem

A cover assembly and an aerosol generating device to which the cover assembly is applied are provided. Specifically, when one end of the mouthpiece is pressed, the cover assembly may be opened or closed by rotating around the other end of the mouthpiece. Accordingly, the mouthpiece may be easily opened and closed, and when not in use, the mouthpiece may prevent foreign materials from entering the mouthpiece.

The problems to be solved by the embodiments are not limited to the above-described problems, and undescribed problems may be clearly understood by those skilled in the art to which the present disclosure belongs from the present specification and the accompanying drawings.

Technical Solution

A cover assembly may include a mouthpiece that includes one end, which comes into contact with a mouth of a user, and another end, the one end being opened and closed by rotation of the mouthpiece around the other end, and an accommodation unit for accommodating the one end of the mouthpiece when the one end is closed, wherein the accommodation unit includes a button unit that is in contact with the one end of the mouthpiece and is displaced in a longitudinal direction when the one end is pressed, and a locking unit including a first portion in contact with the one end of the mouthpiece and a second portion in contact with the button unit.

Advantageous Effects

According to embodiments of the present disclosure, a mouth portion of a mouthpiece may be in a closed position so as not to be exposed to the outside, and thus, hygiene may be improved, and a protrusion portion of the device is minimized to increase aesthetics and portability. In addition, a mouthpiece may be opened and closed semi-automatically, and thus, convenience of a user may be increased.

Effects of embodiments of the present disclosure are not limited to the above-described effects, and undescribed effects will be clearly understood by those skilled in the art to which the present disclosure belongs from the present specification and the accompanying drawings.

BEST MODE

Figure 1A:
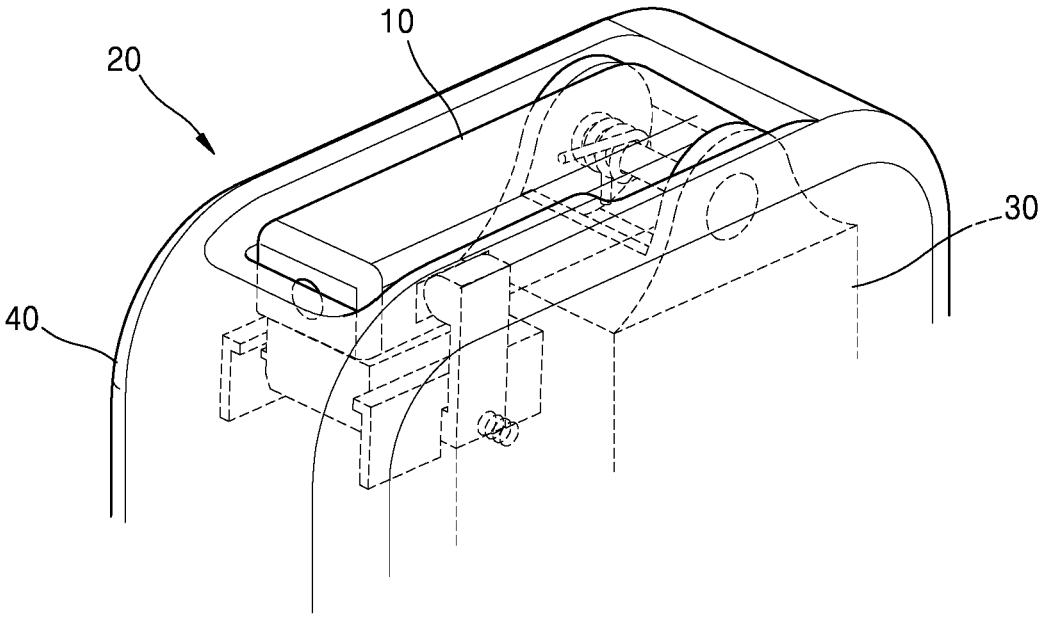
FIG. 1A is a view illustrating a cover assembly coupled to an aerosol generating device, according to an embodiment.

According to one or more embodiments, a cover assembly is provided. The cover assembly includes: a mouthpiece including one end, that is configured to come into contact with a mouth of a user, and another end opposite to the one end, the mouthpiece configured to move to an open position and a closed position by rotation of the mouthpiece around the other end; and an accommodation unit for accommodating the one end of the mouthpiece in the closed position. The accommodation unit includes: a button unit including a body, the button unit configured to contact the one end of the mouthpiece and to be displaced in a longitudinal direction based on the one end being pressed; and a locking unit including a body, the body of the locking unit including a first portion that is configured to contact the one end of the mouthpiece and a second portion that is configured to contact the button unit.

According to an embodiment, the first portion of the locking unit is configured to be coupled to the mouthpiece such as to fix the mouthpiece, and is further configured to be separated from the mouthpiece by being moved in a transverse direction based on the second portion being pressed by the button unit being longitudinally displaced.

According to an embodiment, the one end of the mouthpiece is configured to move to the open position based on the locking unit being separated from the mouthpiece.

According to an embodiment, the first portion of the body of the locking unit includes a protrusion portion, and the mouthpiece includes a groove having a shape that is configured to couple to the protrusion portion.

According to an embodiment, the protrusion portion includes a curved surface.

According to an embodiment, the second portion of the body of the locking unit includes a sliding portion that is an inclined surface, and the body of the button unit includes an inclined surface that has a shape corresponding to the sliding portion.

According to an embodiment, the cover assembly further includes: a first elastic body in contact with at least a part of an outer surface of the locking unit; and a second elastic body coupled to the other end of the mouthpiece, wherein the first elastic body is configured to return the locking unit to a position after the locking unit is moved, and the second elastic body is configured to rotate the other end of the mouthpiece based on the mouthpiece being separated from the locking unit.

According to an embodiment, a speed at which the second elastic body is configured to rotate the other end of the mouthpiece is faster than a speed at which the first elastic body is configured to return the locking unit to the position.

According to an embodiment, the first elastic body is a compression spring, and the second elastic body is a torsion spring.

According to an embodiment, the accommodation unit further includes a guide unit including a body, the guide unit configured to limit displacement of the button unit to a predetermined range.

According to an embodiment, the mouthpiece further includes a passage extending from the one end to the other end such as to allow an aerosol to pass therethrough.

According to an embodiment, a cross-sectional area of the one end of the mouthpiece is smaller than a cross-sectional area of the other end of the mouthpiece.

According to one or more embodiments, an aerosol generating device is provided. The aerosol generating device includes the cover assembly and a medium storage.

According to an embodiment, the mouthpiece further includes a passage extending from the one end to the other end such as to allow an aerosol to pass therethrough, and the medium storage communicates with the passage based on whether the mouthpiece is in the open position or the closed position.

According to an embodiment, the medium storage includes a liquid cartridge or a granular cartridge.

MODE FOR INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. Also, in a special case, there may be terms that are arbitrarily selected by the applicant. In this case, the meanings of the terms will be described in detail in the description of the present disclosure. Thus, the terms used herein will be defined based on not simply the names of the terms but the meanings thereof and contents of the present disclosure.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element is referred to as being "over," "above," "on," "below," "under," "beneath," "connected to" or "coupled to" another element, it can be directly over, above, on, below, under, beneath, connected or coupled to the other element or intervening elements may be present. In contrast, when an element is referred to as being "directly over," "directly above," "directly on," "directly below," "directly under," "directly beneath," "directly connected to" or "directly coupled to" another element, there are no intervening elements present.

In addition, unless explicitly described to the contrary, the word "comprise" and variations such as "comprises" or "comprising"" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

In addition, terms including ordinal numbers such as "first" or "second" used in the present specification may be used to describe various components, but the components should not be limited by the terms. Terms are used only for the purpose of distinguishing one component from another component.

In addition, some of components in the drawings may be illustrated to be somewhat exaggerated in size or ratio. In addition, components illustrated in some drawings may not be illustrated in other drawings.

Hereinafter, example embodiments of the present disclosure will now be described more fully with reference to the accompanying drawings such that one of ordinary skill in the art may easily work the present disclosure. Embodiments of the present disclosure may, however, be embodied in many different forms and should not be construed as being limited to the example embodiments set forth herein.

Figure 1B:
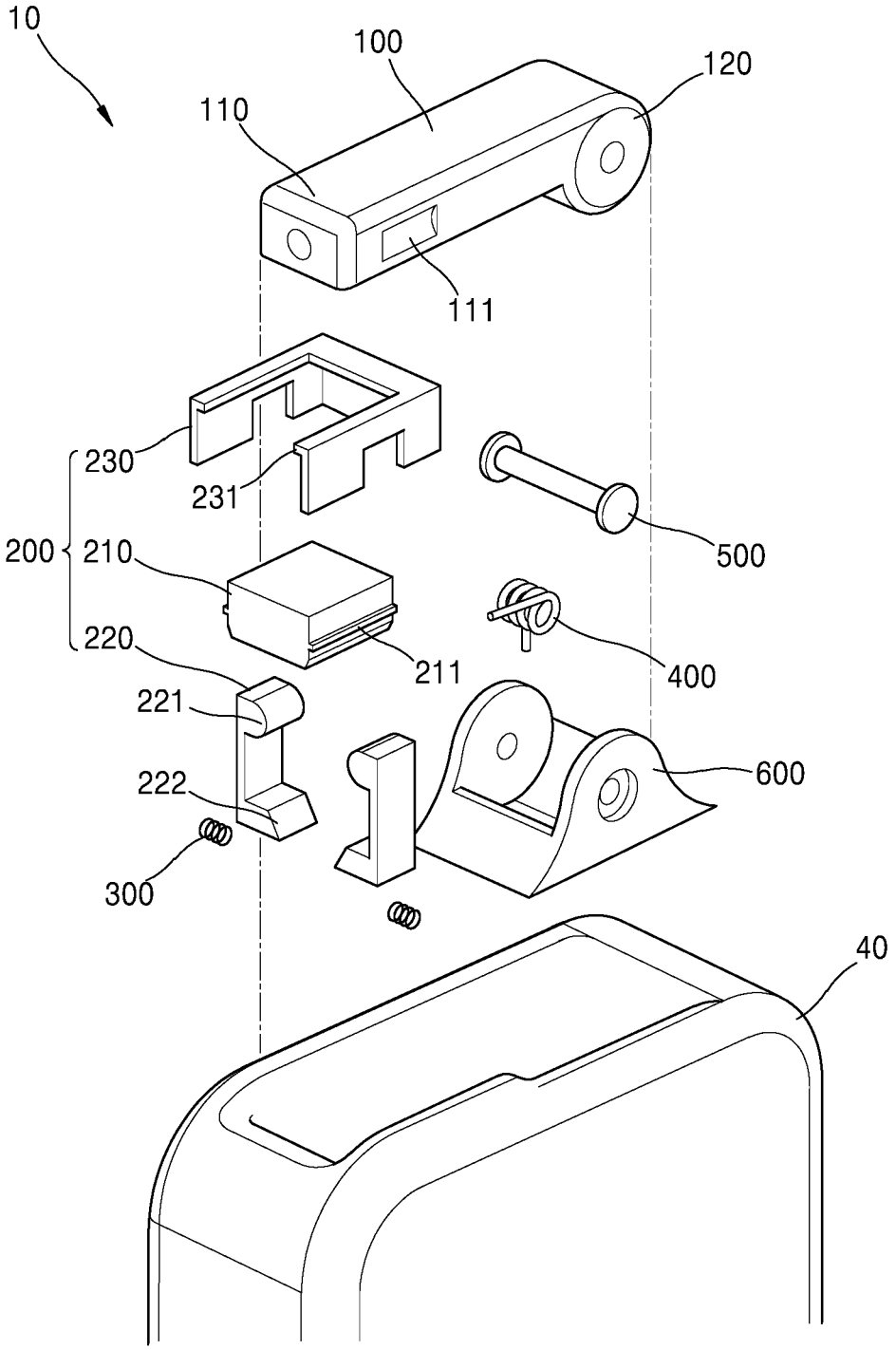
FIG. 1B is an exploded view of the cover assembly of FIG. 1A.

FIG. 1A is a view illustrating a cover assembly coupled to an aerosol generating device according to an embodiment, and FIG. 1B is an exploded view of the cover assembly of FIG. 1A.

Referring to FIG. 1A, an aerosol generating device 20 according to an embodiment may include a case 40, a medium storage 30, and a cover assembly 10. Specifically, the medium storage 30 may be included in the case 40. In addition, the cover assembly 10 may be adjacent to at least part of the medium storage 30, and at least some components of the cover assembly 10 are included in the case 40, and at least part of a mouthpiece 100 (refer to FIG. 1B) constituting the cover assembly 10 may be exposed to the outside of the case 40.

Meanwhile, those skilled in the art related to the present embodiment will be able to understand without difficulty that the aerosol generating device 20 according to another embodiment may further include other general-purpose components for generating an aerosol as well as the components illustrated in FIG. 1A.

Referring to FIG. 1B, the cover assembly 10 may include the mouthpiece 100, an accommodation unit 200, a button unit 210, a locking unit 220, a guide unit 230, a first elastic body 300, a second elastic body 400, a rotation shaft 500, and a shaft support 600. Hereinafter, a specific structure of each component and a coupling relationship with other components will be described.

The mouthpiece 100 may include one end 110 that comes into contact with a mouth of a user and the other end 120 opposite to the one end 110, and as the mouthpiece 100 rotates around the other end 120, the one end 110 may be moved to an opened or closed position. In addition, the other end 120 of the mouthpiece 100 may be coupled to a rotation shaft 500 and the second elastic body 400.

In addition, the shaft support 600 may be in contact with at least part of the other end 120 of the mouthpiece 100 to be coupled to the other end 120 of the mouthpiece 100 together with the rotation shaft 500.

The accommodation unit 200 may include the button unit 210 that is in contact with the one end 110 of the mouthpiece 100 and is displaced in a longitudinal direction by pressing the one end 110. According to one embodiment, when the one end 110 of the mouthpiece 100 is pressed by a user, the button unit 210 in contact with the one end 110 of the mouthpiece 100 may also be pressed by the mouthpiece 100 to be displaced in the longitudinal direction. The longitudinal direction may be a longitudinal direction of the aerosol generating device 20.

In addition, the accommodation unit 200 may include the locking unit 220 that includes a first portion in contact with the one end 110 of the mouthpiece 100 and a second portion in contact with the button unit 210. According to one embodiment, as the first portion of the locking unit 220 is coupled to the mouthpiece 100, the mouthpiece 100 may be fixed, and as the second portion is pressed by the longitudinal displacement of the button unit 210 to move the locking unit 220 in a transverse direction, the locking unit 220 may be separated from the mouthpiece 100.

The transverse direction may be a direction crossing both a longitudinal direction of the aerosol generating device 20 and a direction facing the one end 110 of the closed mouthpiece 100.

The locking unit 220 may be separated from the mouthpiece 100 by moving in the transverse direction by being pressed by the button unit 210 that is displaced in the longitudinal direction. Specifically, as the first portion of the locking unit 220 is separated from the mouthpiece 100, the one end 110 of the mouthpiece 100 may be moved to an opened position. That is, as the one end 110 is pressed, the mouthpiece 100 may be separated from the locking unit 220 to be opened semi-automatically.

In contrast to this, when the mouthpiece 100 is closed, the one end 110 of the mouthpiece 100 and the locking unit 220 may be coupled to each other to fix the mouthpiece 100 in a closed state.

The locking unit 220 may include a protrusion portion 221. Specifically, the locking unit 220 may include the protrusion portion 221 in at least part of the first portion, and the mouthpiece 100 may include a groove 111 having a shape couplable to the protrusion portion 221.

In addition, the protrusion portion 221 may include a curved surface, and the groove 111 of the mouthpiece 100 may also include a curved surface having a shape corresponding to the curved surface of the protrusion portion 221. Specifically, the curved surface of the protrusion portion 221 may be convex, and the curved surface of the groove 111 may be concave.

As the protrusion portion 221 and the groove 111 include the curved surfaces, the button unit 210 may be easily displaced by pressing the one end 110 of the mouthpiece 100. Specifically, when the mouthpiece 100 is closed, the one end 110 of the mouthpiece 100 may be displaced within a predetermined range. For example, when the one end 110 of the mouthpiece 100 is pressed in the longitudinal direction, the protrusion portion 221 and the groove 111 may be finely separated, and the mouthpiece 100 may be displaced in the longitudinal direction, and accordingly, the button unit 210 may be pressed.

Meanwhile, the locking unit 220 may include a sliding portion 222 having the second portion formed as an inclined surface, and the button unit 210 may include an inclined surface having a shape corresponding to the sliding portion 222. Specifically, when the button unit 210 is pressed by the mouthpiece 100 to be displaced in the longitudinal direction, sliding occurs on the inclined surface, and the sliding portion 222 of the locking unit 220 may be pressed in the transverse direction. Accordingly, as the locking unit 220 moves in the transverse direction, the mouthpiece 100 may be separated from the first portion, and the mouthpiece 100 no longer receives a binding force. Accordingly, the mouthpiece 100 rotates around the other end 120, and the one end 110 of the mouthpiece 100 may be moved to the opened position.

The cover assembly 10 may further include the first elastic body 300 and the second elastic body 400. The first elastic body 300 may be in contact with at least part of an outer surface of the locking unit 220. Specifically, when the one end 110 of the mouthpiece 100 is in the closed position, the first elastic body 300 may be inserted in a finely deformed state into a space between the locking unit 220 and the case 40 to apply an elastic force to the locking unit 220. For example, a direction of the elastic force of the first elastic body 300 may be the aforementioned transverse direction.

Here, a state in which the first elastic body 300 is finely deformed may mean a deformed state to the extent that the first elastic body 300 may apply a fine elastic force to the locking unit 220 so that the mouthpiece 100 and the locking unit 220 may be maintained in a coupled state in the first portion or the curved surface.

In addition, when the locking unit 220 is pressed by the button unit 210 to move, the first elastic body 300 may be further deformed. That is, the first elastic body 300 may be in a more deformed state than the finely deformed state described above. Because an elastic body generates an elastic force in proportion to the degree of deformation according to Hook's Law, when the locking unit 220 moves, the first elastic body 300 may apply a greater elastic force to the locking unit 220 to return the locking unit 220 to an original position.

Meanwhile, the first elastic body 300 may correspond to a compression spring or an elastic pad. However, embodiments of the present disclosure are not limited thereto, and those skilled in the art related to the present embodiment may understand without difficulty that various types of elastic bodies capable of providing elasticity to the locking unit 220 may be included in the present disclosure.

As described above, the second elastic body 400 may be coupled to the other end 120 of the mouthpiece 100 together with a rotation shaft 500. Specifically, when the one end 110 of the mouthpiece 100 is in the closed position, the second elastic body 400 may be coupled to the other end 120 of the mouthpiece 100 in a slightly deformed state to apply an elastic force to the other end 120 of the mouthpiece 100.

Here, the slightly deformed state may refer to a state in which, when the mouthpiece 100 and the locking unit 220 are separated from each other, the second elastic body 400 applies a rotational force to the other end 120 of the mouthpiece 100 to move the one end 110 of the mouthpiece 100 to the opened position.

Meanwhile, the second elastic body 400 may be a torsion spring. However, embodiments of the present disclosure are not limited thereto, and various types of elastic bodies capable of providing a rotational force to the other end 120 of the mouthpiece 100 may be included in the present disclosure.

According to one embodiment, a speed at which the mouthpiece 100 is opened may be faster than a speed at which the locking unit 220 returns. For example, a speed at which the second elastic body 400 rotates the other end 120 of the mouthpiece 100 may be faster than a speed at which the first elastic body 300 returns the locking unit 220.

Specifically, the second elastic body 400 may be made of a material or a dimension that generates a greater elastic force than the first elastic body 300. For example, an elastic modulus of the second elastic body 400 may be an elastic body having a value greater than an elastic modulus of the first elastic body 300.

The accommodation unit 200 may further include a guide unit 230 for limiting displacement of the button unit 210 to a predetermined range. The guide unit 230 may be located between the locking unit 220 and the button unit 210, and a position of the guide unit 230 may be fixed by being in contact with at least part of the button unit 210 and/or at least part of the locking unit 220.

The accommodation unit 200 may include an empty space between the button unit 210 and the locking unit 220, and as the button unit 210 is displaced into the empty space due to impact or so on of the cover assembly 10, the locking unit 220 may not move in the transverse direction and the mouthpiece 100 may not be opened.

In order to prevent this, the guide unit 230 may be located in at least part of the empty space, and the guide unit 230 may guide the button unit 210 so that the button unit 210 may be displaced within a certain range inside the accommodation unit 200.

In addition, the guide unit 230 may include a locking projection 231 for limiting longitudinal displacement of the button unit 210 to a predetermined range, and the button unit 210 may include a protrusion 211 that may be caught on locking projection 231. Accordingly, it is possible to prevent the button unit 210 pressed by the locking unit 220, which is returned to an original position again by receiving an elastic force of the first elastic body 300, from being displaced to a position where the one end 110 of the mouthpiece 100 is accommodated, after the one end 110 of the mouthpiece 100 is moved to the opened position.

Referring to the above description, as the guide unit 230 is further included in the accommodation unit 200, coupling between the locking unit 220 and the button unit 210 may be more solid, and the mouthpiece 100 may be semi-automatically opened and closed more smoothly.

Figure 2A:
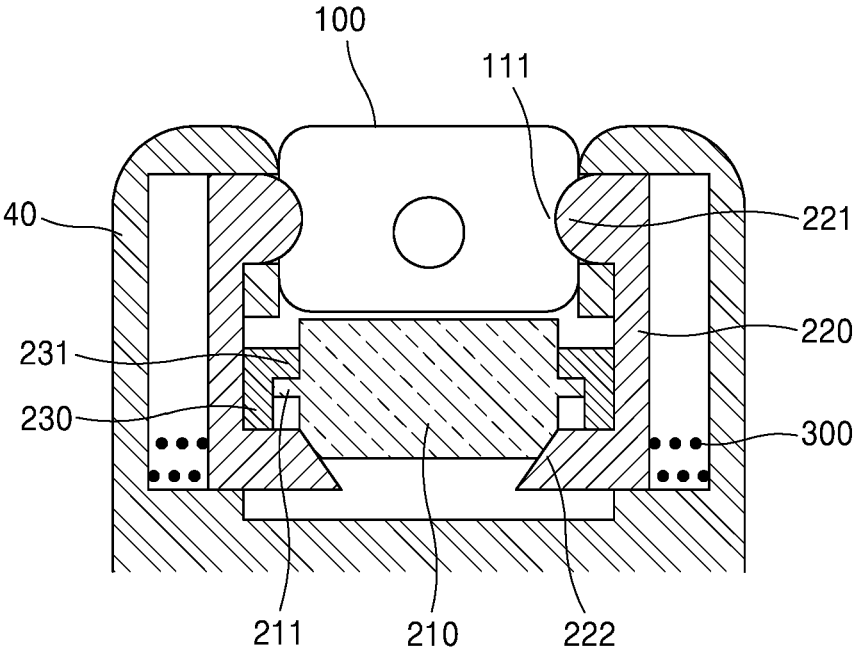
FIG. 2A is a front cross-sectional view of a cover assembly according to an embodiment.
Figure 2B:
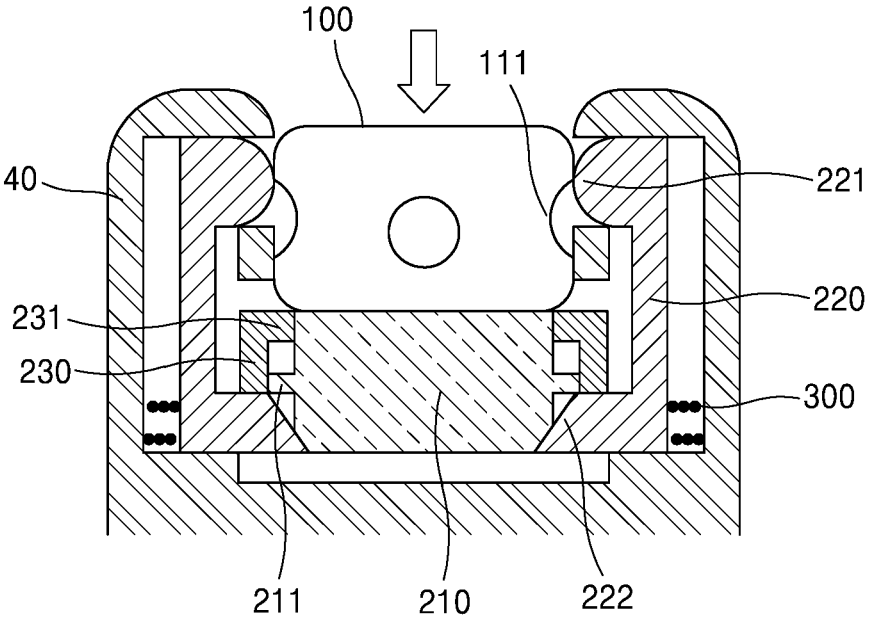
FIG. 2B is a view illustrating one aspect of the cover assembly illustrated in FIG. 2A.
Figure 2C:
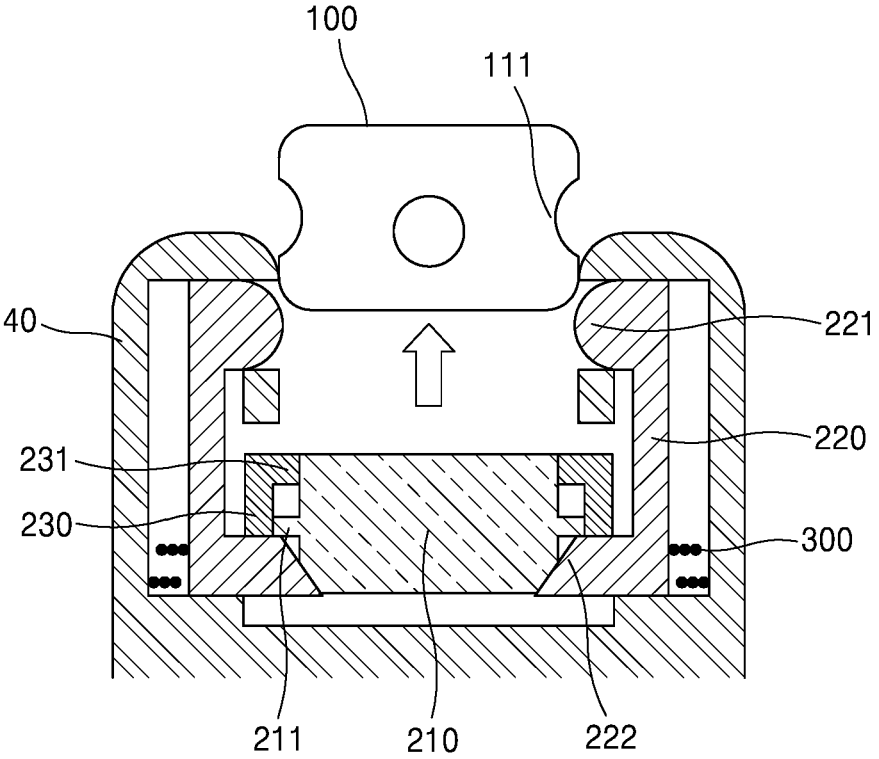
FIG. 2C is a view illustrating another aspect of the cover assembly illustrated in FIG. 2A.

FIG. 2A is a front cross-sectional view of a cover assembly according to an embodiment, FIG. 2B is a view illustrating one aspect of the cover assembly illustrated in FIG. 2A, and FIG. 2C is a view illustrating another aspect of the cover assembly illustrated in FIG. 2A.

The cover assembly according to an embodiment will be described in more detail with reference to FIGS. 2A to 2C.

Referring to FIG. 2A, the mouthpiece 100, the locking unit 220, the button unit 210, the guide unit 230, the first elastic body 300, and the case 40 are illustrated. Specifically, the mouthpiece 100, while in the closed position, may be accommodated in the accommodation unit 200 comprising the locking unit 220, the button unit 210, and the guide unit 230, and the protrusion portion 221 of the locking unit 220 and the groove 111 of the mouthpiece 100 may be combined and fixed in an accommodated state.

In addition, the mouthpiece 100 may further include a passage extending from the one end 110 to the other end 120 so that an aerosol may pass therethrough. A cross section of the passage is illustrated in a circular shape but is not limited thereto, and a passage having a cross section of various shapes may be included therein.

The locking unit 220 may include the protrusion portion 221, including a curved surface, and a second portion that is spaced apart from the protrusion portion 221 and in contact with the button unit 210. In addition, the second portion may include the sliding portion 222. In addition, the locking unit 220 may be composed of two members having symmetrical properties.

When the locking unit 220 is composed of two members, the mouthpiece 100 and the button unit 210 may include two of the groove 111 and two of the inclined surface and two of the protrusion 211, respectively. Accordingly, semi-automatic opening and closing of the mouthpiece 100 may be made more balanced.

Meanwhile, there may be a predetermined space between the locking unit 220 and an inner wall of the case 40 so that the locking unit 220 may move in the transverse direction. The first elastic body 300 may be inserted into at least part of the predetermined space.

The button unit 210 may include the two of the inclined surface and the two of the protrusion 211. The inclined surfaces may each have a shape corresponding to a respective one of the sliding portion 222 of the locking unit 220 and may convert longitudinal displacement of the button unit 210 to a transverse movement of the locking unit 220. In addition, the protrusion 211 may have a shape that may be caught on a respective one of the locking projection 231 included in the guide unit 230.

As described above, the first elastic body 300 may be inserted into a space between the locking unit 220 and the inner wall of the case 40. Specifically, the first elastic body 300 may be in contact with at least part of an outer surface of the locking unit 220 and in contact with at least part of the inner wall of the case 40.

According to FIGS. 2A to 2C, two of the first elastic body 300 are illustrated to be provided in lower portions of spaces between the locking unit 220 and the case 40 but are not limited thereto, and the first elastic body 300 may be provided in another place where a position of the locking unit 220 moved by being pressed by the button unit 210 may be returned. In addition, more than two of the first elastic body 300 may be included in the cover assembly 10.

Hereinafter, a semi-automatic opening/closing mechanism of the mouthpiece 100 included in the cover assembly 10 will be described with reference to FIGS. 2B and 2C.

Referring to FIG. 2B, after the one end 110 of the mouthpiece 100 is pressed, a positional relationship of each component of the cover assembly 10 may be known.

Specifically, when the one end 110 of the mouthpiece 100 is pressed, slip occurs on the groove 111 of the mouthpiece 100 and on a curved surface of the protrusion portion 221 of the locking unit 220, and at the same time, the mouthpiece 100 may press at least part of the button unit 210 to displace the button unit 210 in the longitudinal direction.

In addition, the button unit 210 is displaced in the longitudinal direction along the sliding portion 222 of the protrusion portion 221 by the mouthpiece 100, and at the same time, the locking unit 220 is pressed on the sliding portion 222 by the protrusion portion 221 to move in the transverse direction, and thus, the mouthpiece 100 may be separated from the locking unit 220.

Referring to FIG. 2C, after the pressing on the one end 110 of the mouthpiece 100 is removed, a positional relationship of each component of the cover assembly 10 in which the mouthpiece 100 and the locking unit 220 are separated from each other may be seen.

As illustrated in FIG. 2C, when the mouthpiece 100 and the locking unit 220 are separated from each other, the second elastic body 400 rotates the other end 120 of the mouthpiece 100, and thus, the one end 110 of the mouthpiece 100 may be exposed.

In this case, a speed at which the second elastic body 400 rotates the other end 120 of the mouthpiece 100 may be faster than a speed at which the first elastic body 300 returns the moved locking unit 220. Accordingly, only after the mouthpiece 100 is opened, the compressed first elastic body 300 may return the locking unit 220 to an original position thereof. In response to this operation, the button unit 210 may be returned to an original position thereof.

Figure 3A:
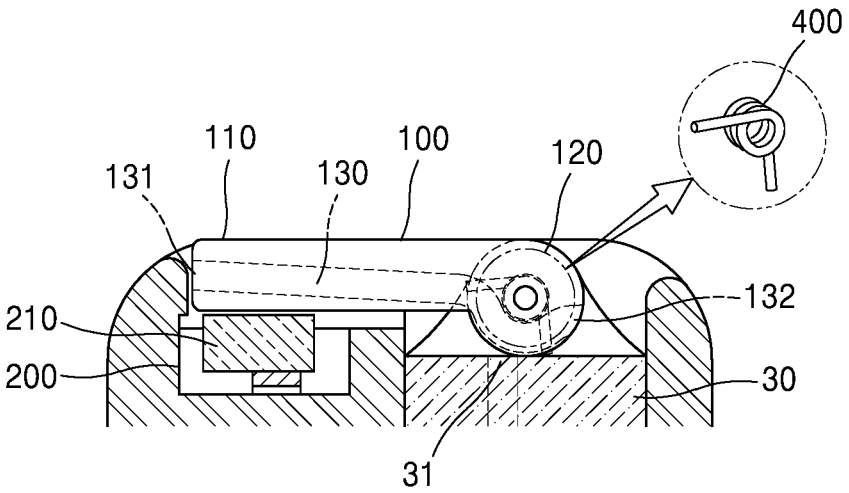
FIG. 3A is a side cross-sectional view of a cover assembly according to an embodiment.
Figure 3B:
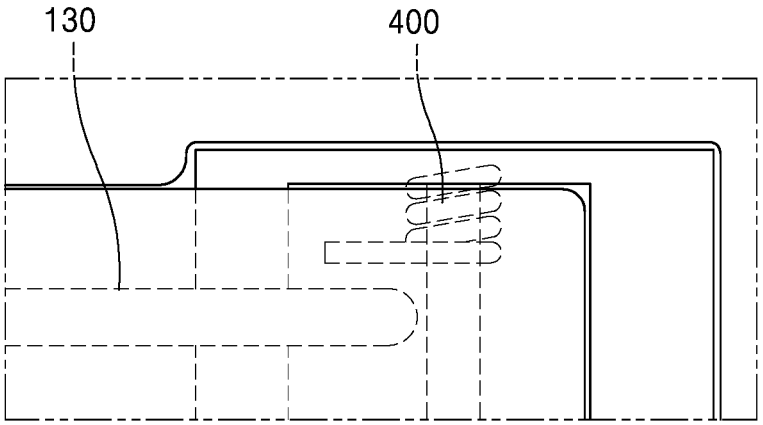
FIG. 3B is a partial plan view of the cover assembly illustrated in FIG. 3A.
Figure 3C:
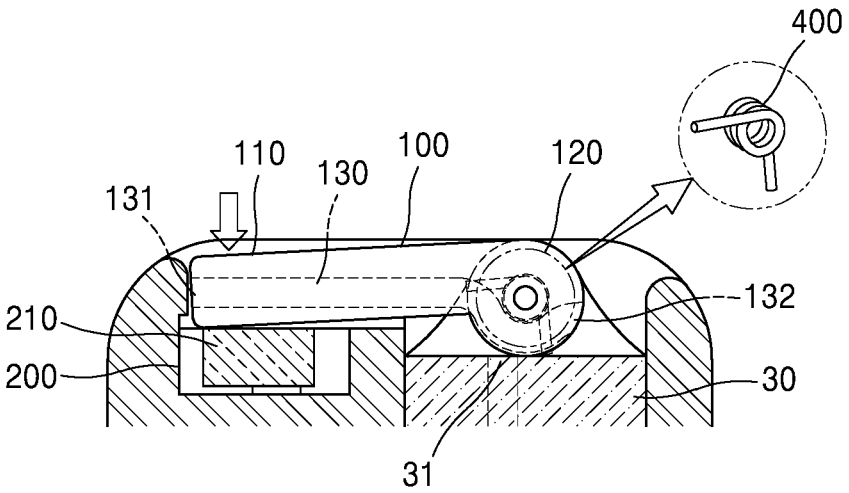
FIG. 3C is a view illustrating one aspect of the cover assembly illustrated in FIG. 3A.
Figure 3D:
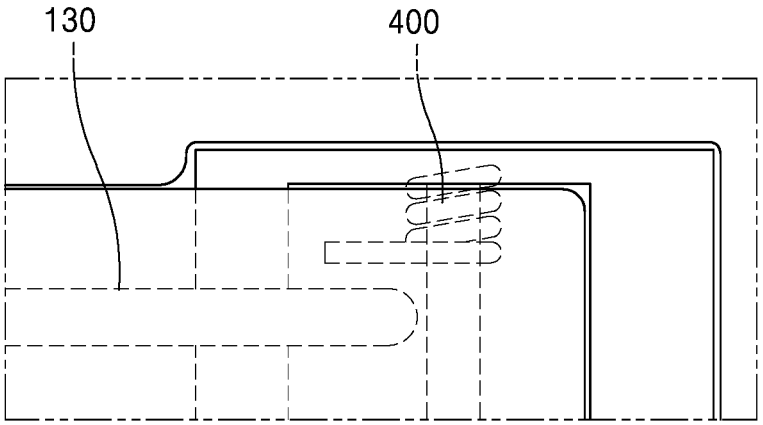
FIG. 3D is a partial plan view of the cover assembly illustrated in FIG. 3C.
Figure 3E:
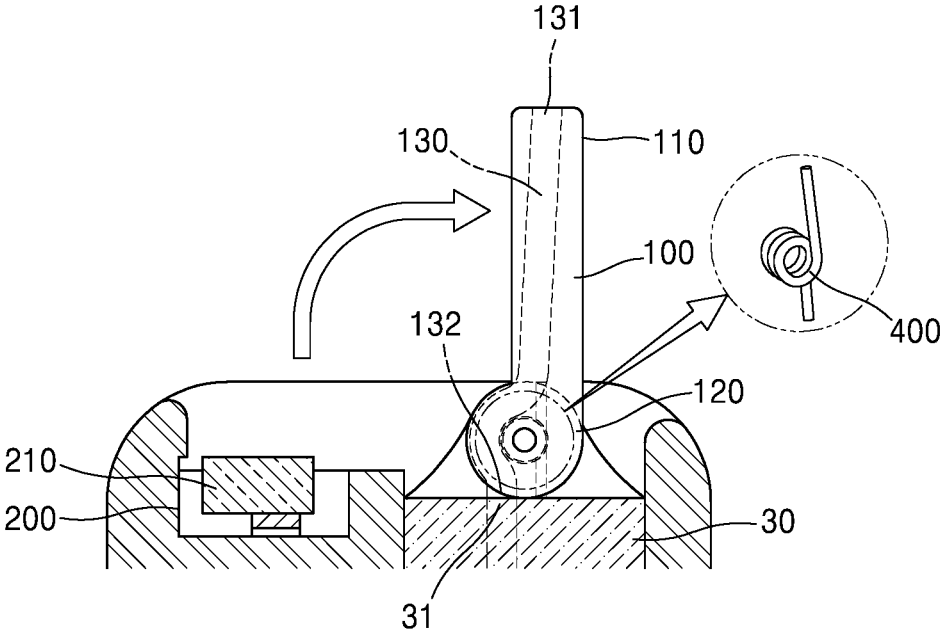
FIG. 3E is a view illustrating another aspect of the cover assembly illustrated in FIG. 3A.
Figure 3F:
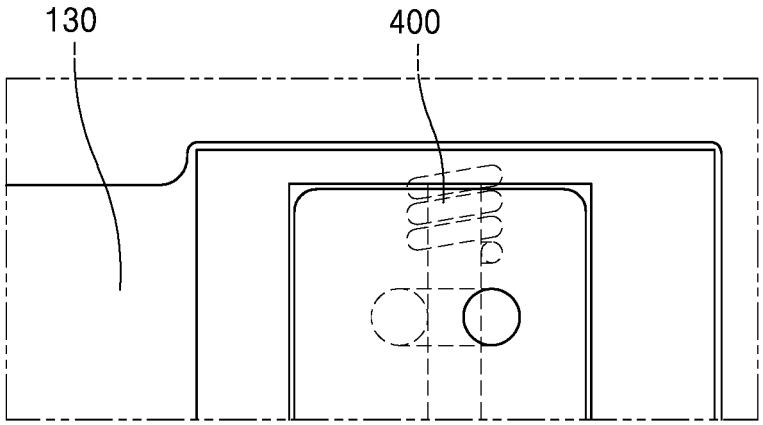
FIG. 3F is a partial plan view of the cover assembly illustrated in FIG. 3E.

FIG. 3A is a side cross-sectional view of a cover assembly according to an embodiment, FIG. 3B is a partial plan view of the cover assembly illustrated in FIG. 3A, FIG. 3C is a view illustrating one aspect of the cover assembly illustrated in FIG. 3A, FIG. 3D is a partial plan view of the cover assembly illustrated in FIG. 3C, FIG. 3E is a view illustrating another aspect of the cover assembly illustrated in FIG. 3A, FIG. 3F is a partial plan view of the cover assembly illustrated in FIG. 3E.

Hereinafter, a cover assembly according to an embodiment will be described in more detail with reference to FIGS. 3A to 3F. In order to aid understanding, the second elastic body 400 is enlarged.

Referring to FIG. 3A, it can be seen that the mouthpiece 100 is closed and the one end 110 of the mouthpiece 100 is accommodated in the accommodation unit 200. That is, FIG. 3A may correspond to FIG. 2A, and illustrates a state in which the mouthpiece 100 is fixed by a locking unit.

In a state where the mouthpiece 100 is closed, the second elastic body 400 may be in a deformed state. That is, the second elastic body 400 applies a torque to the other end 120 of the mouthpiece 100, but the locking unit is coupled to the mouthpiece 100, and thus, the mouthpiece 100 may be in a fixed state so as not to rotate.

The mouthpiece 100 may include a passage 130 extending from the one end 110 to the other end 120 so that the aerosol may pass therethrough, and the passage 130 may further include a distal portion 132 arranged close to the other end 120 of the mouthpiece 100 and a proximal portion 131 arranged close to the one end 110 of the mouthpiece 100.

Specifically, the proximal portion 131 refers to a hole through which an aerosol exits through the passage 130 of the mouthpiece 100, and the distal portion 132 refers to a hole through which an aerosol generated from the medium storage 30 enters the passage 130 of the mouthpiece 100.

Referring to FIG. 3C, it can be seen that the one end 110 of the mouthpiece 100 is in a pressed state. In addition, it can be seen that the button unit 210 is displaced in the longitudinal direction when the mouthpiece 100 is pressed. That is, FIG. 3C may correspond to FIG. 2B and illustrates that the button unit 210 is displaced in the longitudinal direction, the locking unit moves in the transverse direction, and the mouthpiece 100 and the locking unit are separated from each other. In addition, the distal portion 132 of the mouthpiece 100 may be in a state in which the distal portion 132 is not connected to the medium storage 30.

When the mouthpiece 100 is closed, the second elastic body 400 may be in a deformed state. For example, the second elastic body 400 may be in a state in which an arm is twisted by about 90 degrees. Specifically, the deformed second elastic body 400 applies a rotational force to the other end 120 of the mouthpiece 100, but because the one end 110 of the mouthpiece 100 is pressed, the mouthpiece 100 is not in the opened state.

Referring to the plan view illustrated in FIG. 3D, it can be seen that the second elastic body 400 having the number of turns of three is coupled to one end of the rotation shaft 500 in a deformed state. In addition, in order to adjust an opening speed of the mouthpiece 100, the second elastic body 400 having the different number of turns may be coupled to the rotation shaft 500, and an additional one of the second elastic body 400 may be further coupled to the other end of the rotation shaft 500.

Referring to FIG. 3E, it can be seen that the mouthpiece 100 is in an opened state. That is, FIG. 3E may correspond to FIG. 2C, and illustrates a state in which the mouthpiece 100 rotates around the other end 120 to be opened. In addition, the distal portion 132 of the mouthpiece 100 may be connected to the medium storage 30.

In a state in which the mouthpiece 100 is opened, the second elastic body 400 may be in a non-deformed state. For example, the arm of the second elastic body 400 may not be twisted. Specifically, the second elastic body 400 may be returned to an original shape, and the mouthpiece 100 may be opened by receiving a rotational force.

According to embodiments, the arm of the second elastic body 400 may be twisted by about 20 degrees. Accordingly, even in a state in which the mouthpiece 100 is opened, the second elastic body 400 may apply a predetermined rotational force to the other end 120 in a state of being deformed by a predetermined angle. Accordingly, when a user inhales an aerosol through the mouthpiece 100, the mouthpiece 100 may not rotate easily in the direction in which the mouthpiece 100 is closed.

Referring to the plan view illustrated in FIG. 3F, it can be seen that the second elastic body 400 having the number of turns of 3 is coupled to one end of the rotation shaft 500 in a non-deformed state.

Figure 4A:
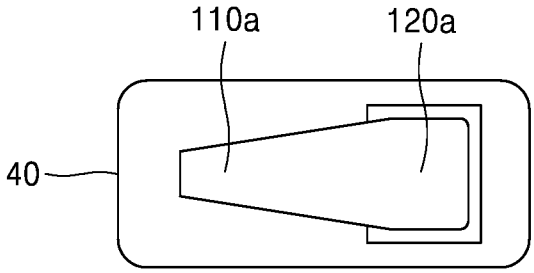
FIG. 4A is a plan view of a cover assembly according to another embodiment.

FIG. 4A is a plan view of a cover assembly according to another embodiment.

Referring to FIG. 4A, a cross-sectional area of one end 110*a* of a mouthpiece may be smaller than a cross-sectional area of the other end 120*a* thereof. Specifically, as the mouthpiece extends from the other end 120*a* to one end 110*a*, a width of the mouthpiece may be linearly narrowed. Accordingly, a more precise operation may be required to press the one end 110*a* of the mouthpiece, and the one end 110*a* of the mouthpiece may be prevented from being pressed accidentally.

For example, when a user does not intend to open the mouthpiece, it is possible to prevent the mouthpiece from being opened when the one end 110*a* of the mouthpiece comes into contact with an object or a user. In addition, when a user intends to open the mouthpiece, the user may open the mouthpiece by precisely pressing the one end 110*a* of the mouthpiece having a narrow cross-sectional area.

Figure 4B:
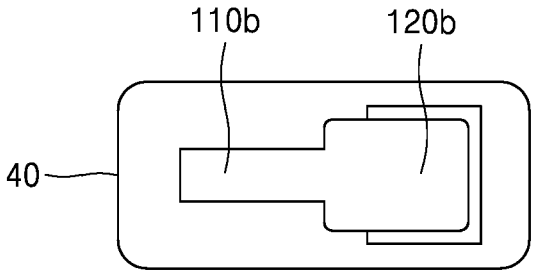
FIG. 4B is a plan view of a cover assembly according to another embodiment.

FIG. 4B is a plan view of a cover assembly according to another embodiment.

Referring to FIG. 4B, a cross-sectional area of one end 110*b* of a mouthpiece may be smaller than a cross-sectional area of the other end 120*b*. For example, a width of the mouthpiece may be changed based on a predetermined point between the other end 120*b* and the one end 110*b*.

Specifically, the width of the mouthpiece is changed at a midpoint between the one end 110*b* and the other end 120*b*, and thus the width of the one end 110*b* may be smaller than the width of the other end 120*b*. Accordingly, it is possible to prevent the mouthpiece from being opened again by excessively pressing the one end of the mouthpiece when a user moves the one end 110*b* of the mouthpiece to the closed position with a finger.

For example, a user may press the one end 110*b* of the mouthpiece with a finger to close the open mouthpiece. As the width of the one end 110*b* is narrow, a finger may touch part of the case 40 at the time when a groove of the one end 110*b* and a protrusion of a locking unit are coupled to each other.

In this way, when the mouthpiece is closed, the one end 110*b* of the mouthpiece is prevented from being excessively pressed, and thus, a button unit may be prevented from being displaced in the longitudinal direction. Accordingly, the mouthpiece may be pressed only until being coupled to the locking unit.

Meanwhile, the above-described effects are not limited to the shapes of the mouthpieces illustrated in FIGS. 4A and 4B and may be realized by various shapes of mouthpieces that facilitate opening and closing of the mouthpiece.

Figure 5A:
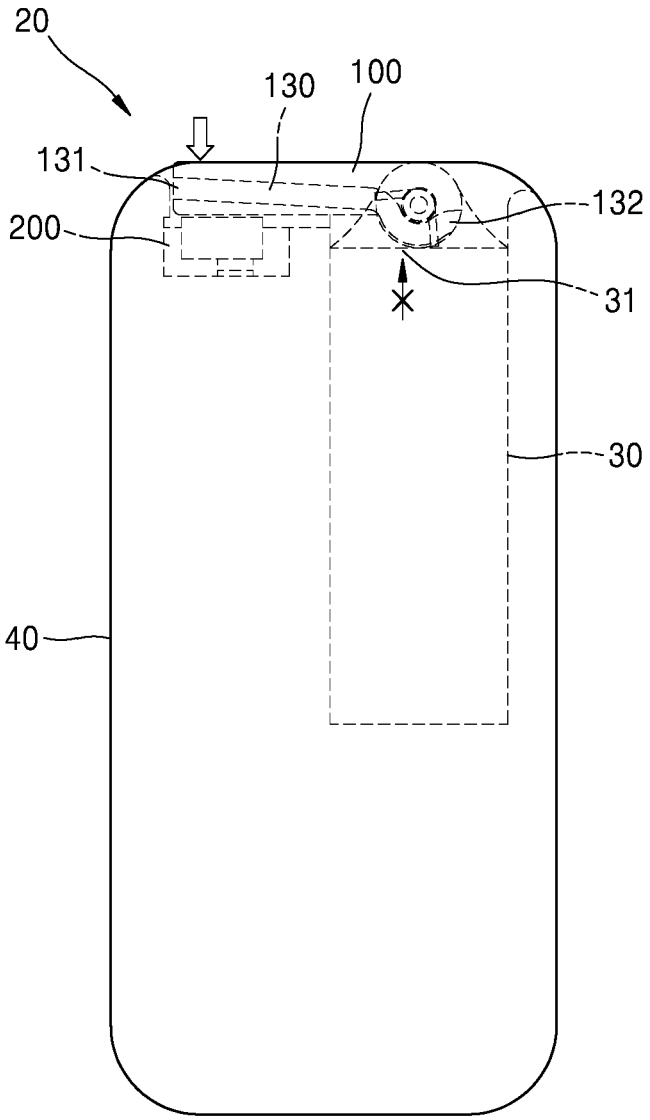
FIG. 5A is a view illustrating one aspect of an aerosol generating device according to an embodiment.
Figure 5B:
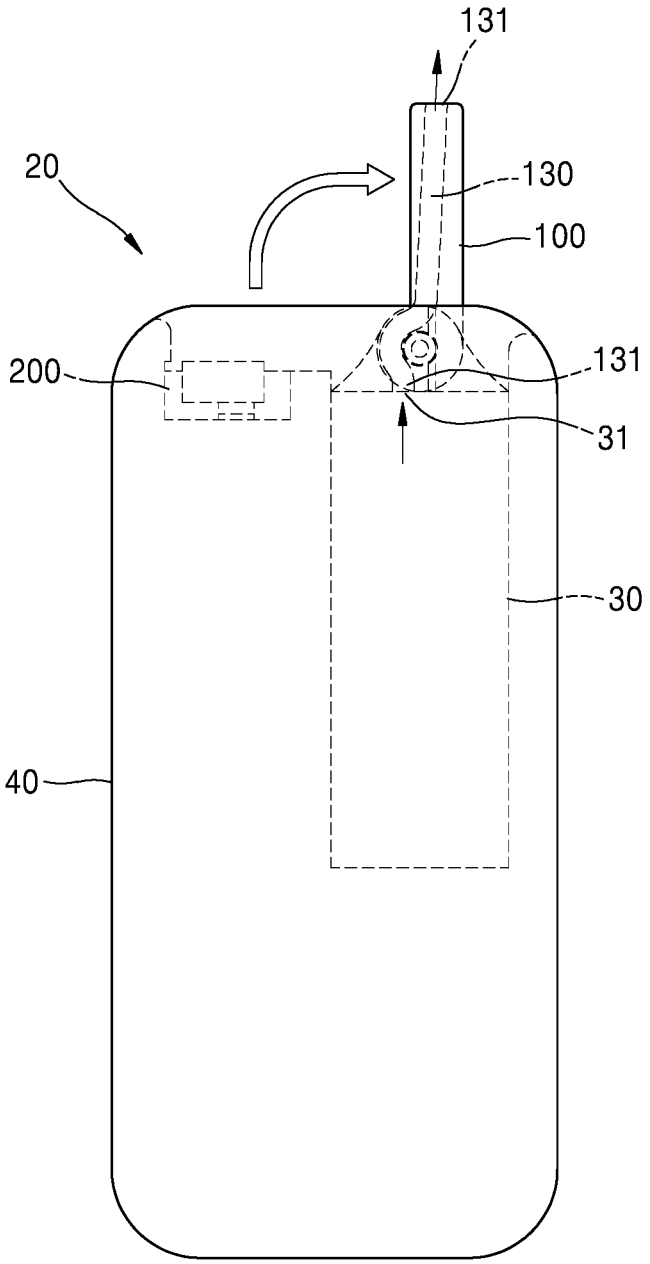
FIG. 5B is a view illustrating another aspect of an aerosol generating device according to an embodiment.

FIG. 5A is a view illustrating one aspect of an aerosol generating device according to an embodiment, and FIG. 5B is a view illustrating another aspect of an aerosol generating device according to an embodiment.

Hereinafter, an aerosol generating device 20 according to an embodiment to which a cover assembly 10 is applied will be described in more detail with reference to FIGS. 5A and 5B.

The aerosol generating device 20 according to the embodiment may include the cover assembly 10 and the medium storage 30 according to the above-described embodiments, and an aerosol generated from the medium storage 30 may exit to the outside through a mouthpiece 100.

According to opening and closing of the mouthpiece 100, the aerosol generating device 20 according to the embodiment may be changed from one aspect illustrated in FIG. 5A to another aspect illustrated in FIG. 5B, and in contrast to this, the aerosol generating device 20 may be changed from the another aspect illustrated in FIG. 5B to the one aspect illustrated in FIG. 5A.

Referring to FIG. 5A, a cover structure in which the mouthpiece 100 is closed and a medium storage 30 are illustrated. The mouthpiece 100 may include a passage 130 connecting one end to the other end of the mouthpiece 100 to allow an aerosol to pass therethrough, and the passage 130 may include a distal portion 132 and a proximal portion 131. The medium storage 30 may be located inside the case 40 and may further include at least one ejection port 31.

According to one embodiment, the medium storage 30 may communicate with the mouthpiece 100 based on whether the mouthpiece 100 is opened or closed. Specifically, when the mouthpiece 100 is in a closed state, the distal portion 132 of the passage 130 of the mouthpiece 100 is not connected to the ejection port 31 of the medium storage 30 as illustrated in FIG. 5A, and thus, the medium storage 30 may not communicate with the passage 130, and an aerosol in the medium storage 30 may not exit to the outside of the aerosol generating device 20.

Meanwhile, when the mouthpiece 100 is in an open state, the distal portion 132 of the passage 130 of the mouthpiece 100 is connected to the ejection port 31 of the medium storage 30 as illustrated in FIG. 5B, and thus, the medium storage 30 and the passage 130 may communicate with each other, and an aerosol in the medium storage 30 may exit from the aerosol generating device 20.

Power of the aerosol generating device 20 may be turned on/off based on whether the mouthpiece 100 is opened or closed. Specifically, when the mouthpiece 100 is in a closed state, the power may be turned off so that the aerosol generating device 20 does not operate to prevent an aerosol from being generated from the medium storage 30. Meanwhile, when the mouthpiece 100 is in an open state, the power may be turned on so that the aerosol generating device 20 may operate.

For example, the aerosol generating device 20 may further include a sensor and a processor, and the sensor may detect a position change signal of a configuration of the aerosol generating device 20 that changes according to whether the mouthpiece 100 is opened or closed. The processor may turn on/off a power of the aerosol generating device 20 based on a signal detected by the sensor.

The medium storage 30 may include a liquid cartridge or a granular cartridge. The liquid cartridge may store a liquid composition. For example, the liquid composition may be a liquid including a tobacco-containing material including a volatile tobacco flavor component or may be a liquid including a non-tobacco material. In addition, the granulation cartridge may store a material containing the same component as the liquid composition or a similar component to the liquid composition in the form of granules or capsules.

The aerosol generating device 20 may accommodate a liquid cartridge and may include a vaporizer that generates an aerosol by heating a liquid in the liquid cartridge. The vaporizer for heating a liquid may be referred to as a cartomizer or an atomizer but is not limited thereto. The aerosol generating device 20 may generate an aerosol through the vaporizer after accommodating the liquid cartridge.

The medium storage 30 may be replaceable. Specifically, the medium storage 30 may also be manufactured to be detachable from/attachable to the aerosol generating device 20 or may also be manufactured integrally with the aerosol generating device 20.

The aerosol generating device 20 according to an embodiment may further include components for generating an aerosol therein. For example, the aerosol generating device 20 may include a battery, a processor, and a heater or an ultrasonic vibrator.

The configuration and effects of the cover assembly 10, which is included in the aerosol generating device 20, may be the same as the cover assembly 10 described above with respect to FIGS. 1A-4B, and detailed descriptions overlapping the configuration and effects are omitted.

Those skilled in the art related to embodiments of the present disclosure may understand without difficulty that general-purpose components for generating an aerosol may be further included in the aerosol generating device 20.

Those of ordinary skill in the art related to the present embodiments may understand that various changes in form and details can be made therein without departing from the scope of the characteristics described above. The disclosed methods should be considered in a descriptive sense only and not for purposes of limitation.

What is claimed is:

1. A cover assembly comprising:

a mouthpiece including one end, that is configured to come into contact with a mouth of a user, and another end opposite to the one end, the mouthpiece configured to move to an open position and a closed position by rotation of the mouthpiece around the other end; and an accommodation unit for accommodating the one end of the mouthpiece in the closed position, wherein the accommodation unit comprises:

a button unit comprising a body, the button unit configured to contact the one end of the mouthpiece and to be displaced in a longitudinal direction based on the one end being pressed; and a locking unit comprising a body, the body of the locking unit comprising a first portion that is configured to contact the one end of the mouthpiece and a second portion that is configured to contact the button unit.

2. The cover assembly of claim 1, wherein the first portion of the locking unit is configured to be coupled to the mouthpiece such as to fix the mouthpiece, and is further configured to be separated from the mouthpiece by being moved in a transverse direction based on the second portion being pressed by the button unit being longitudinally displaced.

3. The cover assembly of claim 2, wherein the one end of the mouthpiece is configured to move to the open position based on the locking unit being separated from the mouthpiece.

4. The cover assembly of claim 1, wherein the first portion of the body of the locking unit comprises a protrusion portion, and the mouthpiece comprises a groove having a shape that is configured to couple to the protrusion portion.

5. The cover assembly of claim 4, wherein the protrusion portion comprises a curved surface.

6. The cover assembly of claim 1, wherein the second portion of the body of the locking unit comprises a sliding portion that is an inclined surface, and the body of the button unit comprises an inclined surface that has a shape corresponding to the sliding portion.

7. The cover assembly of claim 1, further comprising:

a first elastic body in contact with at least a part of an outer surface of the locking unit; and a second elastic body coupled to the other end of the mouthpiece, wherein the first elastic body is configured to return the locking unit to a position after the locking unit is moved, and the second elastic body is configured to rotate the other end of the mouthpiece based on the mouthpiece being separated from the locking unit.

8. The cover assembly of claim 7, wherein a speed at which the second elastic body is configured to rotate the other end of the mouthpiece is faster than a speed at which the first elastic body is configured to return the locking unit to the position.

9. The cover assembly of claim 7, wherein the first elastic body is a compression spring, and the second elastic body is a torsion spring.

10. The cover assembly of claim 1, wherein the accommodation unit further comprises a guide unit comprising a body, the guide unit configured to limit displacement of the button unit to a predetermined range.

11. The cover assembly of claim 1, wherein the mouthpiece further includes a passage extending from the one end to the other end such as to allow an aerosol to pass therethrough.

12. The cover assembly of claim 1, wherein a cross-sectional area of the one end of the mouthpiece is smaller than a cross-sectional area of the other end of the mouthpiece.

13. An aerosol generating device comprising:

the cover assembly according to claim 1; and a medium storage.

14. The aerosol generating device of claim 13, wherein the mouthpiece further includes a passage extending from the one end to the other end such as to allow an aerosol to pass therethrough, and the medium storage communicates with the passage based on whether the mouthpiece is in the open position or the closed position.

15. The aerosol generating device of claim 13, wherein the medium storage comprises a liquid cartridge or a granular cartridge.

* * * * *